US006142199A

United States Patent [19]

Schibline

[11] Patent Number: 6,142,199

[45] Date of Patent: Nov. 7, 2000

[54] MACHINE FOR TRIMMING DECORATIVE MOLDING

[76] Inventor: Larry Schibline, W6476 Subway Rd., Fond du Lac, Wis. 54937

[21] Appl. No.: 09/483,898

[22] Filed: Jan. 18, 2000

[51] Int. Cl.[7] ..... B27C 9/00

[52] U.S. Cl. ..... 144/363; 83/613; 83/633; 83/635; 83/869; 144/134.1; 144/329; 144/2.1

[58] Field of Search ..... 144/2.1, 134.1, 144/329, 363; 83/613, 627, 632, 633, 635, 636, 679, 696, 694, 821, 869

[56] References Cited

U.S. PATENT DOCUMENTS

| | | | |
|---|---|---|---|
| 58,183 | 9/1866 | Whitlock . | |
| 483,095 | 9/1892 | Barrow | 83/635 |
| 2,325,634 | 8/1943 | Rod . | |
| 2,339,641 | 1/1944 | Jensen | 83/613 |
| 3,065,657 | 11/1962 | Thompson | 83/633 |
| 3,559,521 | 2/1971 | Kubala | 83/636 |
| 4,831,910 | 5/1989 | Poulsen | 83/636 |
| 4,881,459 | 11/1989 | Ramun | 83/636 |

*Primary Examiner*—W. Donald Bray
*Attorney, Agent, or Firm*—Donald Cayen

[57] ABSTRACT

A machine trims the ends of decorative molding to match the contour of the face of the molding. The machine comprises a frame that supports a die. The die has an opening therethrough with a die profile that is reversely arranged in comparison with the molding face contour. A punch with a profile that is identical to the molding face contour is reciprocated into and out of engagement with the die. In a first position, the punch is out of engagement with the die such that the end of a piece of molding can be placed between the punch and the die. The punch is actuated to reciprocate into engagement with the die and shear the molding. The punch has a three-dimensional cutting edge with a point between the punch ends. The point contacts the molding first. From the point, the punch cutting edge shears the molding progressively across the molding toward the punch ends.

29 Claims, 4 Drawing Sheets

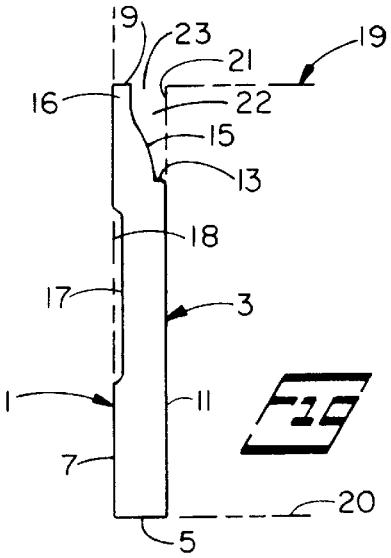
FIG 2
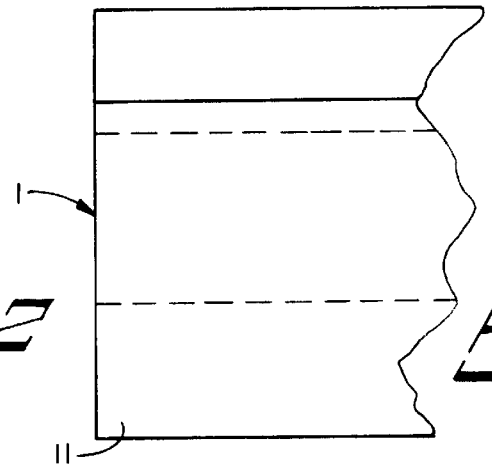
FIG 1
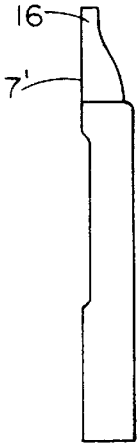
FIG 4
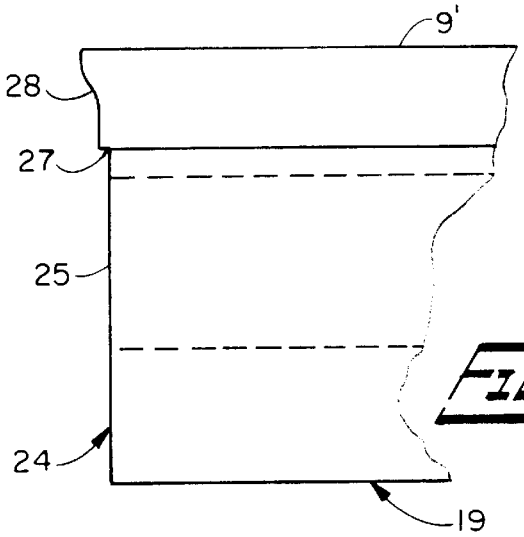
FIG 3
FIG 8
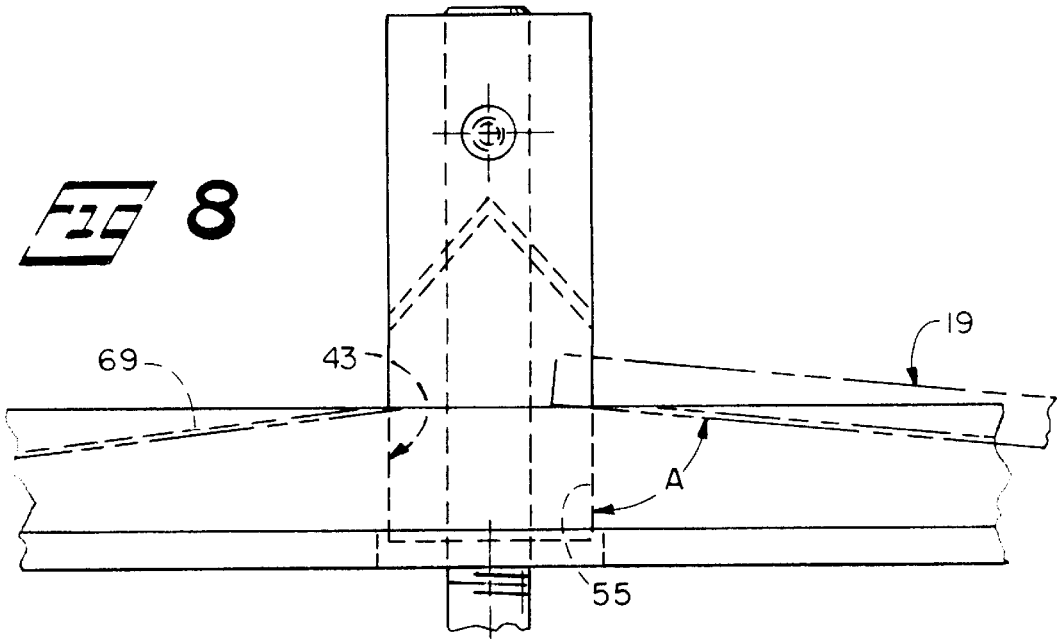

MACHINE FOR TRIMMING DECORATIVE MOLDING

BACKGROUND OF THE INVENTION

This application pertains to building construction, and more particular to apparatus that aids in finishing room interiors.

DESCRIPTION OF THE PRIOR ART

It is well known that aesthetics play an important part in the value of a building. Especially in homes and offices, occupants desire and are willing to pay for attractive surroundings.

To properly finish a room, it is highly desirable that the joints between the floor and the side wall be covered. For that purpose, various types of decorative products have been developed. For example, decorative wooden molding is in common use. The molding face is often contoured with a rather complicated shape that enhances its appearance.

FIGS. 1 and 2 show a popular style of decorative molding 1. The molding 1 has a front face 3, a bottom edge 5, a back edge 7, and a top edge 9. The front face 3 is contoured, having a flat section 11 that terminates in an inward step 13. An ogee curve 15 connects the step 13 and the top edge 9. The molding is quite thin in the region 16 near the top edge at the ogee curve 15. There is a shallow groove 17 in the back side 7. The molding 1 works very well, and it is in widespread use in homes and offices.

Nevertheless, the molding 1 does present a problem during installation in a room at the internal corners between two side walls. A first piece of molding 1 is installed with its back side 7 against a first room wall, represented at phantom line 18 in FIG. 2. The molding bottom edge 5 is placed on the floor, represented by phantom line 20. The molding end abuts the intersecting room wall 22. When a second piece of molding, represented at phantom line 19 in FIG. 2, is laid against the second room wall 22, the end 21 of the second piece abuts the flat section 11 of the first piece. An unsightly and unacceptable gap 23 occurs between the ogee curve 15 of the first piece of molding 1 and the end 21 of the second piece of molding 19.

To eliminate the gap 23, it is standard practice to trim the end 21 of the second molding piece 19 to the shape shown at reference numeral 24 in FIGS. 3 and 4. That is, the end 24 is trimmed to have a straight portion 25 with an outward step 27. An ogee curve 28 connects the step 27 and the molding top edge 9'. The plane of each of the end portions 25, 27, and 28 is generally perpendicular to the molding back side 7'. When the trimmed end 24 of the molding 19 is brought against the front face 3 of the first molding piece 1 (FIG. 2), the end 24 matches the face 3 to present a neat and attractive joint.

Unfortunately, trimming the end 24 was a time consuming and tedious task. The only practical way to trim the end 24 was by hand, using a coping saw or similar tool. A finish carpenter had to be very careful to saw the step 27 and ogee curve 28 to both the right size and shape. Further, it was necessary to cut the correct spatial relations between the ogee curve, step, and straight portion 25. A single error and the carpenter had to start over with a new untrimmed end.

Thus, a need exists for an improved way to install decorative moldings.

SUMMARY OF THE INVENTION

In accordance with the present invention, a machine for trimming decorative molding is provided that greatly improves efficiency and productivity when finishing a room. This is accomplished by apparatus that includes a punch and die having cutting edges with profiles that match the contour of a selected piece of decorative molding.

The die is mounted to a frame at a convenient working height above the floor. The die has an opening through it. The die opening is defined by at least one longitudinal wall having a die profile that is reversely arranged in comparison with the contour of the molding front face that is, the die profile is the reverse of the contour of the front face of the molding.

Transverse walls of the die opening receive respective sliding guides. The guides hold the ends of the punch. The punch has a side surface with a punch profile that is identical to the contour of the front face of the molding to be trimmed. A sharp cutting edge is formed by the junction of the punch side surface with an angled surface inside the punch. In a preferred embodiment, the die has two longitudinal walls with respective die profiles that are mirror images to each other, and the punch has two corresponding mirror image side surfaces each with the punch profile.

The punch is guided by the guides for reciprocation into and out of engagement with the die opening. Reciprocation of the punch is achieved in any convenient way. According to one aspect of the invention, a long rod is connected between the punch and a lever near the bottom of the frame. A spring acts on the lever to bias the punch to a ready position. When in the ready position, the punch is out of engagement with the die such that there is a space between them. Pivoting the lever, as by a foot pedal, actuates the rod to pull the punch into engagement with the die opening.

In use, with the punch in the ready position a piece of decorative molding is placed in the space between the punch and the die, with only a short overhang of the molding end over the die opening. A person pushes rapidly on the foot pedal to pull the punch against the molding and shear it to the profile of the die opening. Upon release of the foot pedal, the spring returns the punch to its ready position for another operation.

It is a feature of the invention that the punch cutting edges need not be straight as viewed toward the side surfaces. In fact, the punch cutting edges will normally be three dimensional. The exact shape of the punch cutting edges will vary, depending on the contour of the front face of the molding to be trimmed. The three dimensional profile is the result of the two-dimensional profile of the side surfaces of the punch in conjunction with the angled surfaces inside the punch. For a popular design of molding, each punch cutting edge has a relatively long straight portion that extends from one end of the punch and that intersects a much shorter straight portion at a sharp point. The short straight portion intersects a curved portion that in turn extends to the punch second end. To reduce the maximum shearing force necessary to trim a molding, the long straight portion of the punch cutting edge is at an oblique angle to the direction of punch reciprocation. The sharp point between the long and short straight portions of the cutting edge contacts the molding first during operation. The point helps to hold the molding in place during the shearing operation. The cutting action occurs along the cutting edge progressively and oppositely across the molding from the point toward the ends of the punch. In that manner, the shearing force required to trim the molding is reduced.

The method and apparatus of the invention, using a punch and die arrangement, thus consistently trims molding to a desired contour. The probability of producing a defective piece is remote, even though the machine is operable at a rapid pace.

Other advantages, benefits, and features of the present invention will become apparent to those skilled in the art upon reading the detailed description of the invention.

BRIEF DESCRIPTION OF THE DRAWINGS

FIG. 1 is a front view of a typical decorative molding that is advantageously trimmed by the machine of the invention.

FIG. 2 is an end view of FIG. 1.

FIG. 3 is a front view of the molding of FIG. 1 showing it in the trimmed condition.

FIG. 4 is an end view of FIG. 3.

FIG. 8 is a view taken along line 8—8 of FIG. 7.

FIG. 9 is a view taken along line 9—9 of FIG. 7 and rotated 90 degrees clockwise.

FIG. 10 is a cross-sectional view taken along line 10—10 of FIG. 9.

FIG. 11 is a view of a piece of molding trimmed by the machine of the invention as viewed toward the bottom edge of the molding.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 7:
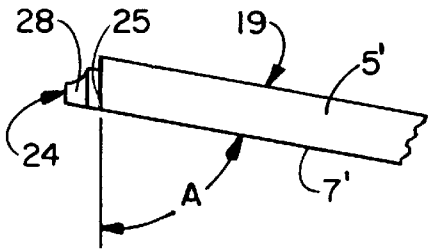
FIG. 7 is a top view on an enlarged scale of FIG. 5.
Figure 6:
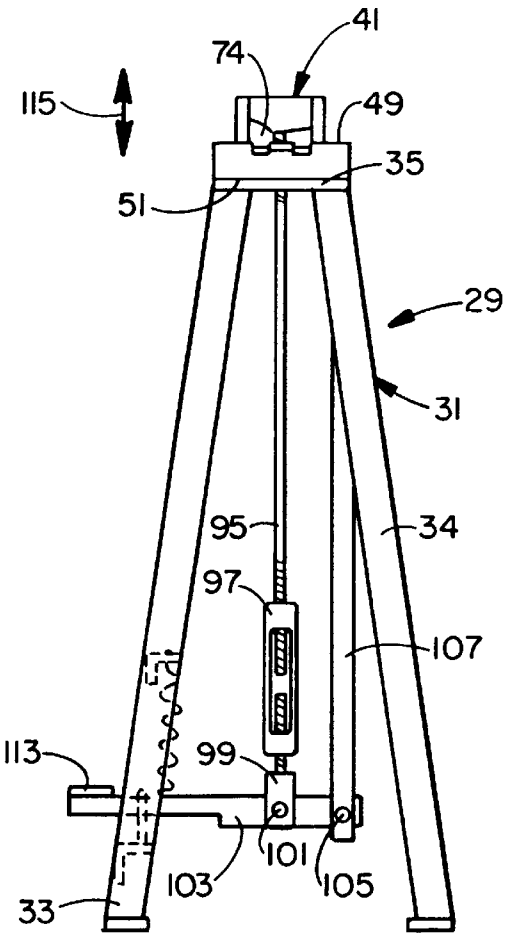
FIG. 6 is a side view of FIG. 5.
Figure 5:
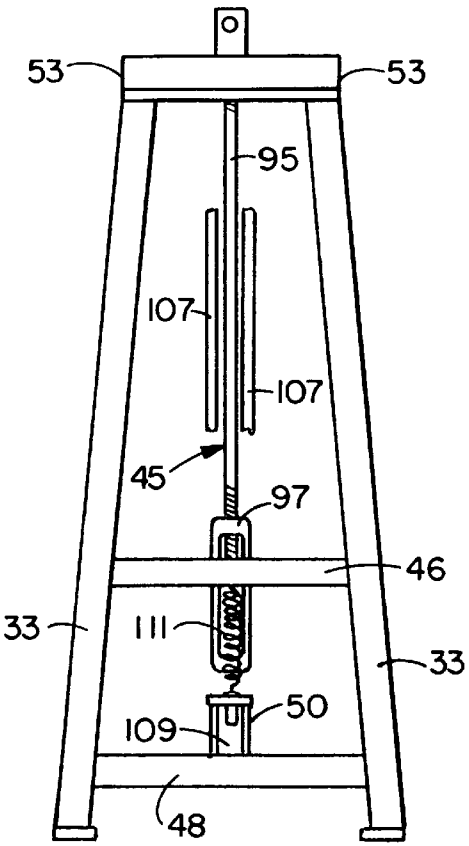
FIG. 5 is a partial front view of the machine of the present invention.
Figure 7:
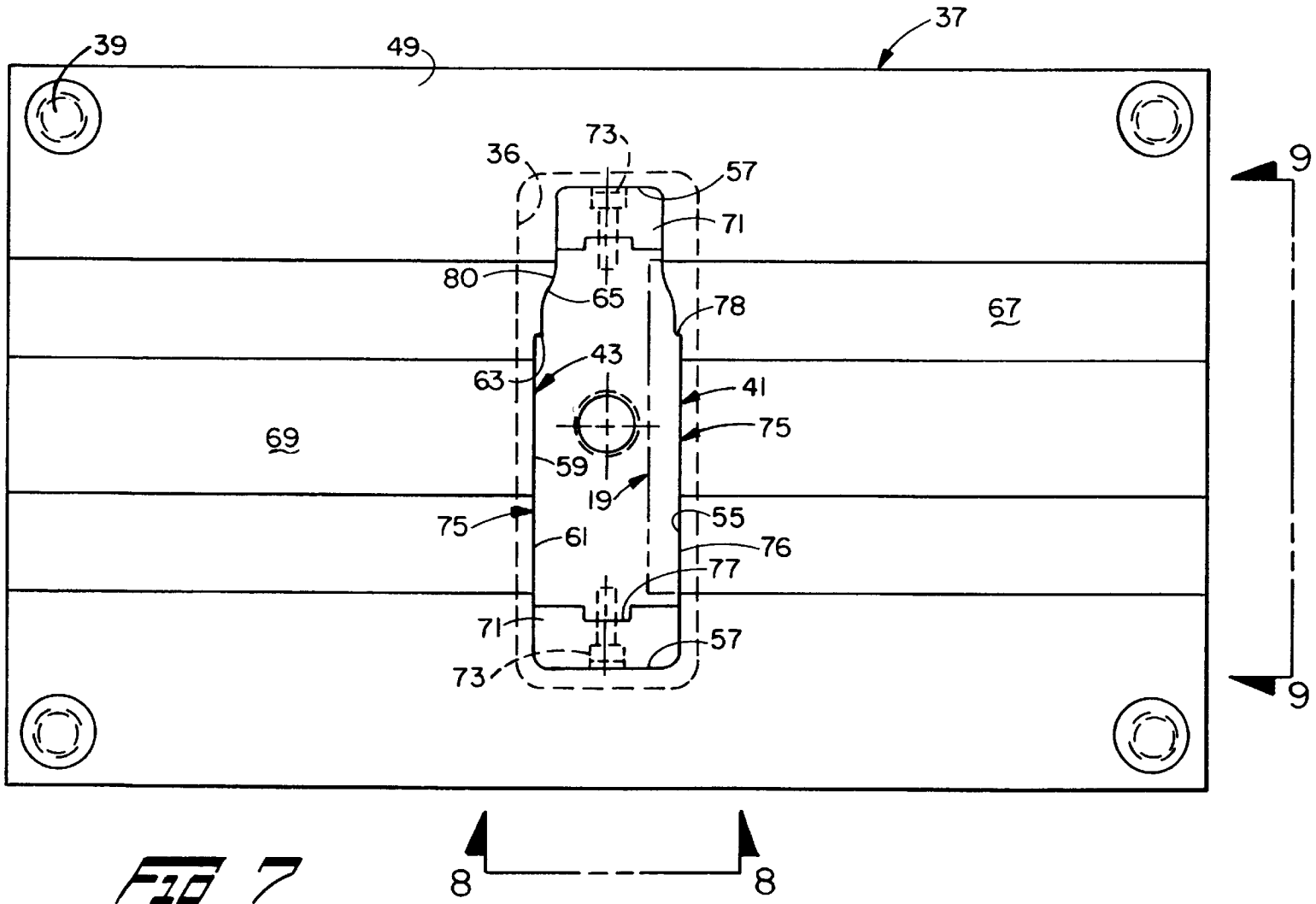
Figure 7:
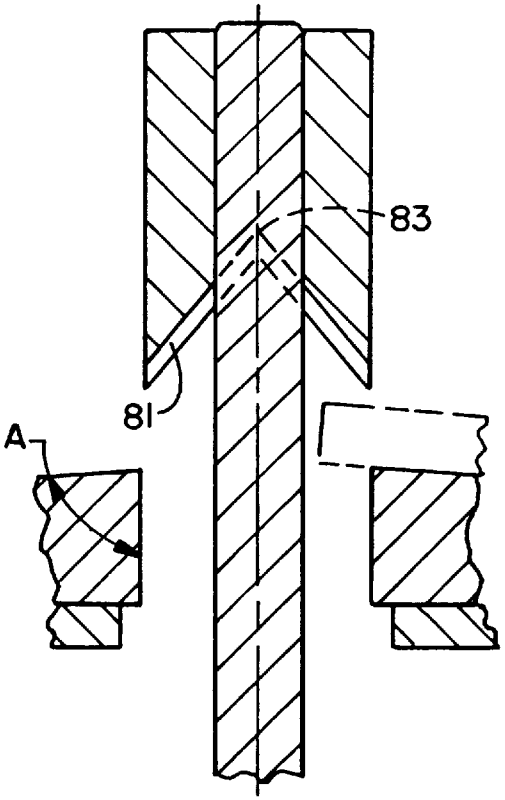
Figure 6:
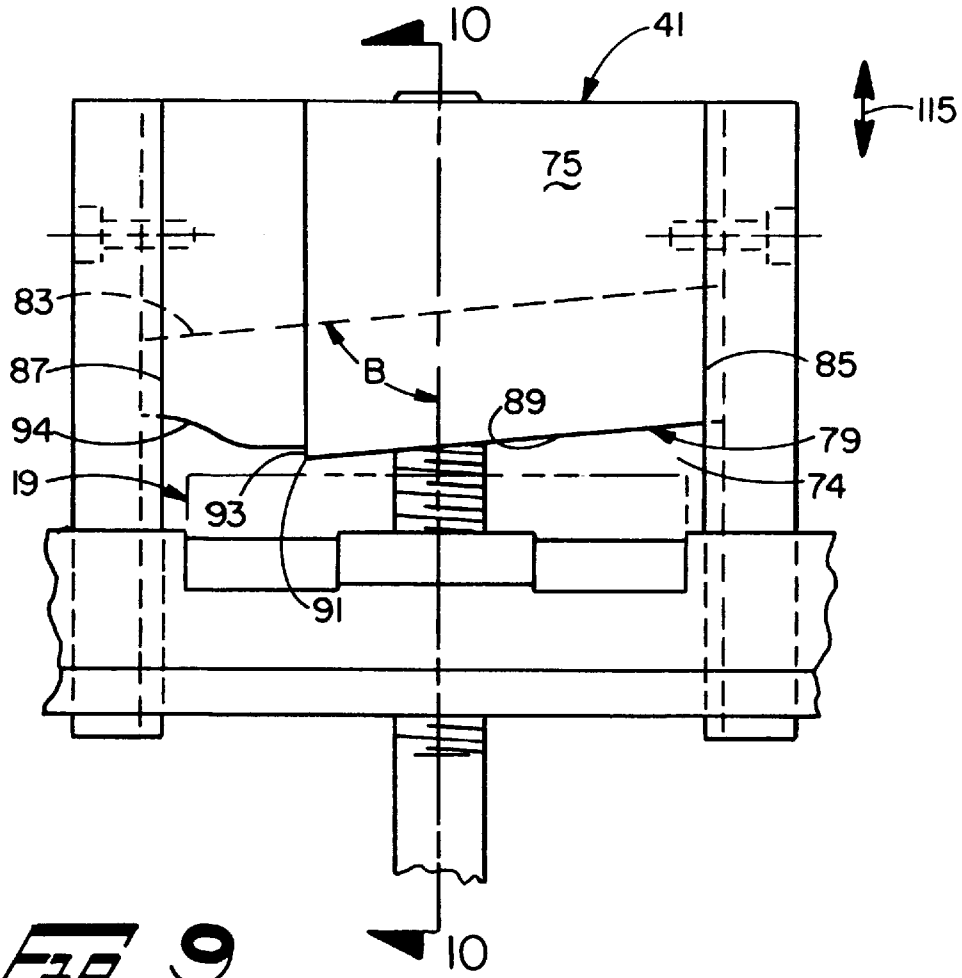

Referring to FIGS. 5–7, a machine 29 for trimming the ends of decorative molding is illustrated that includes the present invention. The machine 29 is disclosed as being used with the molding 1 described in conjunction with FIGS. 1 and 2. However, it will be understood that the invention is not limited to use with any particular configuration of molding.

The machine 29 has an upstanding frame 31. A die 37 is mounted to the frame 31. A punch 41 reciprocates in the directions of arrow 115 into and out of engagement with an opening 43 in the die 37 under the impetus of an actuator 45. In the illustrated construction, the frame 31 is comprised of front legs 33, back legs 34, and a top plate 35. The top plate 35 is preferably approximately waist high to a finish carpenter operating the machine. The frame top plate 35 has a generally rectangular hole 36 through it. The frame also includes a top brace 46 and a bottom brace 48 between the front legs 33. A U-bolt 50 upstands from the bottom brace 48. There are a pair of long angles 107 that are attached to the top plate and that extend to approximately the level of the bottom brace 48.

In the preferred embodiment, the die 37 has a top side 49, a bottom side 51 in contact with the frame top plate 35, and opposite ends 53. The die is mounted to the frame top plate, as by fasteners 39. The die opening 43 is smaller in size than the hole 36 in the frame top plate. The die opening extends between the plate top and bottom sides 49 and 51, respectively. The die opening has symmetrical longitudinal walls 55 and transverse walls 57. The longitudinal walls 55 intersect the top side 49 to form die profiles 59. Each die profile 59 is reversely arranged in comparison to the contour of the front face 3 of the molding 1. That is, each die profile 59 has a straight portion 61, a step 63, and an ogee curve 65. Preferably, the die has channels 67 in the top side 49 between the die opening and the die ends 53. The channels 67 slope toward the die bottom side 51 away from the opening 43 such that each channel makes an angle A with the associated longitudinal wall 55 of the die opening. Also see FIG. 8. A satisfactory angle for the angle A is approximately 80 degrees to 85 degrees. The width of the channels is slightly greater than the dimension between the top and bottom edges 5 and 9, respectively of the molding (FIGS. 1 and 2). A ridge 69 protrudes upwardly from each channel. The height and width of the ridges 69 match the groove 17 of the molding.

Slidably received in the die transverse walls 57 are a pair of guides 91. The guides 91 hold the punch 41 by means of fasteners 73 and a tongue and groove arrangement 77. The guides and punch reciprocate together between a ready position whereat the punch is out of the die opening 43 and a working position whereat the punch is within the die opening. FIGS. 5, 6, and 8 show the punch in the ready position. In that situation, there is a space 74 between the punch and the die. The guides always remain within the die opening.

The punch 41 has longitudinal side surfaces 75 with respective mirror image punch profiles that are identical to contour of the molding from face 3. Specifically, each punch side surface 75 has a straight portion 76, a step 78, and an ogee curve 80. The punch is dimensioned such that it fits very closely within the die opening 43.

As best shown in FIGS. 8 and 10, the punch 41 has V-shaped interior surfaces 81. The apex 83 of the interior surfaces 81 slopes at an angle B relative to the direction of punch reciprocation 115 from one end 85 of the punch toward the other end 87.

Looking also at FIGS. 9 and 10, the illustrated punch 41 has three-dimensional cutting edges 79 at the intersections of the side surfaces and the angled interior surfaces 81, each cutting edge has a first straight portion 89 that is parallel to the apex 83. That is, each cutting edge first portion 89 makes the angle B relative to the direction 115 of punch reciprocation. The first cutting edge portion 89 intersects at a sharp point 91 with a second straight portion 93. From the second straight portion 93, the cutting edge has a three-dimensional ogee shape 94 toward the punch end 87. The three-dimensional ogee shape 94 results from the intersection of the ogee curve 80 of the punch side surface 75 with the angled interior surface 81. The cutting edge second straight portion 93 corresponds to the step 78 in the punch side surface 75, FIG. 7.

In the illustrated construction, the actuator 45 is in the form of a foot pedal mechanism. Returning to FIGS. 5 and 6, a long rod 95 is threaded at one end into the punch 41 and at a second end into a turnbuckle 97. A clevis 99 is also threaded into the turnbuckle 97. The clevis 99 is pivotally connected by a pin 101 to a lever 103. One end of the lever 103 is rotatably attached by a pin 105 to the frame angles 107. The lever 103 passes in the space 109 between the U-bolt 50 and the bottom brace 48. A spring 111 biases the lever upwardly against the bight of the U-bolt. There is a foot plate 113 on the end of the lever opposite the pin 105. As shown in FIGS. 5 and 6, the spring 111, acting through the lever and rod 95, places the punch 41 in the ready position.

When the punch 41 is in the ready position, a carpenter places a piece of molding 19 in one of the die channels 67, with the molding entering the space 74 and overhanging the die opening 43. The molding groove 17 is over the die ridge 69. In FIGS. 7–10, the molding is shown in phantom lines. Holding the molding firmly with his hands, the carpenter rapidly presses downwardly on the foot plate 113 to overcome the force of the spring 111. That action pivots the lever 103 and pulls the rod 95 and punch in the downward direction of the arrow 115. The rapidly moving punch shears the molding to create the contoured end 24, FIGS. 3 and 4. Travel of the lever continues until it strikes the frame bottom brace 48. At that point, the punch is within the die opening 43. The carpenter removes his foot from the foot plate, which enables the spring 111 to return the punch to the ready position. The entire trimming process takes only a few seconds to produce a perfect contoured end.

The shape of the cutting edges 79 of the punch 41 contributes greatly to the successful operation of the machine 29. Looking especially at FIG. 9, as the punch moves toward the molding 19, the cutting edge point 91 contacts the molding first. The sharp point 91 acts initially to hold the molding in place in the die channel 67. In addition, the shearing action occurs initially only adjacent the point 91, and then progresses gradually and oppositely along the straight portion 89 and the ogee portion 94 toward the punch ends 85 and 87. The progressive action of the shearing reduces the force required to trim the molding. The progressive shearing action of the cutting edge at the ogee portion 94 is especially important to make a clean cut on the molding at the thin region 16.

Looking at FIG. 11, the trimmed molding 19 is shown as viewed toward the bottom edge 5'. The straight portion 25 and the curved portion 28 of the contoured edge 24 lie in respective planes that make the angle A with the molding back side 7'. The angle A allows compensation if the side walls at a corner of a room being decorated with the molding is not square.

In summary, the results and advantages of decorative molding can now be more fully realized. The machine 29 provides both rapid trimming of the molding 1 as well as accuracy and consistency in the trimmed ends 24. This desirable result comes from using the combined functions of the punch 41 and the actuator 45. The punch and die 37 have complementary profiles that cooperate to trim the end of a piece of molding to exactly match the contour of the front face 3 of the molding. The punch is reciprocated within the die 37 by the actuator. The actuator spring 111 biases the punch to a ready position. The molding is placed between the punch and the die. Rapid foot operation of the actuator against the spring pulls the punch to shear the molding progressively across its width. The three-dimensional shapes of the punch cutting edges assure that the thin region 16 of the molding does not break off. The cutting edge shape also reduces the force required for the trimming process.

In addition to the superior performance of the machine of the invention, its construction is such as to be of modest cost in relation to the benefits it provides. In fact, the machine pays for itself in a short time because of the increased productivity it brings to finish carpenters.

Thus, it is apparent that there has been provided, in accordance with the invention, a machine for trimming decorative molding that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A machine for trimming the end of a decorative molding having a back side and a face with a predetermined contour comprising:

a. a frame;

b. a die mounted to the frame and having an opening therein with at least one die profile that is reversely arranged in comparison with the contour of the molding face;

c. a punch having at least one side surface with a punch profile that is a identical to the contour of the molding face; and d. actuator means for reciprocating the punch into and out of engagement with the die opening with said at least one punch side surface fitting very closely to said at least one die profile, so that a piece of molding placed between the punch and the die opening when the punch is out of engagement with the die is trimmed to having a trimmed end that has a contour that matches the molding face contour when the actuator means reciprocates the punch into engagement with the die opening.

2. The machine of claim 1 wherein the frame comprises:

a. front and back legs each having a first end that rests on a floor, and a second end that is approximately at waist height of a person standing on the floor; and b. a top plate at the second ends of the front and back legs, the top plate having the die mounted thereto and having a hole therein generally aligned with and larger than the die opening.

3. The machine of claim 1 wherein:

a. the die has top and bottom surfaces and first and second opposed ends, the die opening being defined by opposed longitudinal walls and opposed transverse walls between the top and bottom surfaces, the longitudinal walls containing said at least one die profile; and b. a pair of guides are reciprocable along the die transverse walls, the guides being fastened to the punch to guide the punch into and out of engagement with the die opening.

4. The machine of claim 1 wherein:

a. the die has top and bottom surfaces and first and second opposed ends, the die opening being defined by opposed first and second mirror image longitudinal walls and opposed transverse walls between the top and bottom surfaces, each die longitudinal wall having a die profile that is reversely arranged in comparison with the contour of the molding face; and b. a pair of guides are reciprocable along the die transverse walls, the guides being fastened to the punch to guide the punch into and out of engagement with the die opening.

5. The machine of claim 4 wherein the die has a first channel between the first longitudinal wall of the die opening and the die first end, the channel lying in a plane that makes a predetermined acute angle with the first longitudinal wall of the die opening, the first channel receiving the molding that is trimmed by the machine with the molding back side in facing contact with the channel, so that the trimmed end of the molding makes the predetermined angle with the molding back side.

6. The machine of claim 5 wherein the predetermined angle is between approximately 80 degrees and 85 degrees.

7. The machine of claim 4 wherein the punch has first and second side surfaces having respective punch profiles that are identical in the contour of the molding face.

8. The machine of claim 1 wherein the punch has an interior that is defined by at least one angled surface that intersects said at least one punch side surface along a three-dimensional cutting edge.

9. The machine of claim 8 wherein the three-dimensional cutting edge has a point between the punch ends that makes first contact with the molding when the actuator means reciprocates the punch to engage the die opening.

10. Apparatus for shearing a workpiece to a predetermined contour comprising:

a. a die having an opening therethrough defined by opposed transverse walls and first and second mirror image longitudinal walls having respective first and second die profiles each of which is reversely arranged in comparison with the predetermined contour;

b. a punch having opposed ends and first and second mirror image side surfaces that define respective first and second punch profiles that are identical with the predetermined contour; and c. actuator means for reciprocating the punch in a shearing direction into and out of engagement with the die, a workpiece being placeable between the punch and die when the punch is out of engagement with the die, the punch cooperating with the die to shear the workpiece along a selected one of the die profiles and punch profiles when the actuator means reciprocates the punch into engagement with the die.

11. The apparatus of claim 10 wherein the die is formed with a channel that supports the workpiece, the channel lying in a plane that intersects the die first longitudinal wall, the plane of the channel making a predetermined acute angle with the die first longitudinal wall.

12. The apparatus of claim 10 further comprising a pair of guides each holding an end of the punch, the guides reciprocating within the die transverse walls to guide the punch into and out of engagement with the die.

13. The apparatus of claim 10 wherein the punch defines first and second cutting edges associated with the respective first and second side surfaces, each punch cutting edge being formed by the intersection of the associated side surface and an angled surface inside the punch.

14. The apparatus of claim 10 wherein:

a. the punch has an interior with first and second angled interior surfaces; and b. the punch first and second angled interior surfaces intersect the punch first and second side surfaces at first and second cutting edges, respectively.

15. The apparatus of claim 14 wherein each punch cutting edge has a sharp point between the punch ends that makes first contact with the workpiece, and wherein each cutting edge shears the workpiece progressively and opposingly from the sharp point toward the punch ends when the punch is reciprocated into engagement with the die.

16. The apparatus of claim 10 wherein each die profile and each punch profile contains a straight portion and a curved portion.

17. The apparatus of claim 10 wherein each die profile and each punch profile has a first straight portion, a curved portion, and a second straight portion generally perpendicular to the first straight portion between the first straight portion and the curved portion.

18. The apparatus of claim 17 wherein:

a. the punch has an interior that includes first and second interior angled surfaces that intersect the punch first and second side surfaces, respectively, to thereby form first and second cutting edges; and b. each punch cutting edge has a first straight portion, a curved portion, and a second straight portion between the first straight portion and the curved portion.

19. The apparatus of claim 18 wherein:

a. the first straight portion of each cutting edge of the punch makes a predetermined acute angle with the shearing direction of the punch;

b. the second straight portion of each cutting edge is substantially parallel to the shearing direction of the punch; and c. the first and second straight portions of each cutting edge intersect at a sharp point.

20. The apparatus of claim 19 wherein:

a. the sharp point of a selected punch cutting edge makes first contact with a workpiece during reciprocation of the punch into engagement with the die; and b. the selected punch cutting edge shears the workpiece from the sharp point progressively and opposingly along the cutting edge first straight portion and the curved portion toward the ends of the punch during reciprocation of the punch into engagement with the die.

21. The apparatus of claim 10 wherein the actuator means comprises:

a. a frame that supports the die;

b. a rod passing through the die opening and having a first end received in the punch between the ends thereof, and a second end; and c. lever means for pivoting within the frame to reciprocate the rod.

22. A method of trimming the end of a molding having a face with a predetermined contour, a bottom edge, and a back side such that the trimmed molding end has a contour that matches the molding face contour comprising the steps of:

a. providing a die with an opening partially defined by at least one longitudinal wall having a die profile that is reversely arranged in comparison with the contour of the molding face;

b. providing a punch having a side surface with a punch profile that is identical to the contour of the molding face;

c. reciprocating the punch to a first position whereat it is disengaged from the die such that there is a space between the punch and the die;

d. placing the molding on the die such that an end thereof overlies the die profile;

e. reciprocating the punch into engagement with the die; and f. shearing the molding end with the punch to the contour of the die profile as the punch reciprocates into engagement with the die.

23. The method of claim 22 wherein:

a. the step of providing a die comprises the step of providing a die with an opening defined by transverse walls, and by two mirror image longitudinal walls each of which has a die profile that is reversely arranged in comparison with the contour of the molding face; and b. the step of providing a punch comprises the step of providing a punch with two ends and two mirror image side surfaces each of which has a punch profile that is identical with the contour of the molding face.

24. The method of claim 23 wherein the step of reciprocating the punch into and out of engagement with the die comprises the step of guiding the punch at the ends thereof for reciprocation within the transverse walls of the die.

25. The method of claim 22 wherein:

a. the step of providing a die comprises the step of providing a die having a channel that lies in a plane that makes a predetermined acute angle with said at least one die longitudinal wall; and b. the step of placing the workpiece on the die comprises the step of placing the workpiece in the die channel.

26. The method of claim 22 wherein:

a. the step of providing a die comprises the step of providing a die having a channel that lies in a plane that makes a predetermined acute angle with said at least one die longitudinal wall;

b. the step of placing the molding on the die comprises the step of placing a back side of the workpiece in the die channel; and c. the step of shearing the molding end comprises the step of shearing the molding end such that at least a selected portion of the molding end lies in a plane that makes the predetermined acute angle with the back side of the molding.

27. The method of claim 22 wherein the step of shearing the molding end comprises the steps of:

a. contacting the molding with a point on the punch between the punch ends; and b. shearing the molding from the point progressively toward the punch ends.

28. The method of claim 23 wherein:

a. the step of providing a punch comprises the step of providing a punch having an interior surface that intersects said at least one punch side surface in a cutting edge having a point between the punch ends; and b. the step of shearing the molding comprises the steps of initially contacting the molding with the punch point, and subsequently shearing the molding from the punch point progressively toward the punch ends.

29. The method of claim 22 wherein the step of providing a punch comprises the step of providing a punch with an interior surface that intersects said at least one side surface along a three-dimensional cutting edge.

* * * * *